US006959619B2

(12) United States Patent
Saito et al.

(10) Patent No.: US 6,959,619 B2
(45) Date of Patent: Nov. 1, 2005

(54) STARTER HAVING RESILIENT SHIFT LEVER FOR DRIVING PINION GEAR

(75) Inventors: Mikio Saito, Motosu-gun (JP); Kazuhiro Ando, Okazaki (JP); Kiyokazu Haruno, Kariya (JP); Masahiro Katoh, Chiryu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/681,349

(22) Filed: Oct. 9, 2003

(65) Prior Publication Data

US 2004/0074325 A1 Apr. 22, 2004

Related U.S. Application Data

(62) Division of application No. 09/759,472, filed on Jan. 16, 2001, now Pat. No. 6,658,949.

(30) Foreign Application Priority Data

| | | |
|---|---|---|
| Jan. 17, 2000 | (JP) | 2000-7853 |
| Sep. 8, 2000 | (JP) | 2000-273953 |
| Oct. 25, 2000 | (JP) | 2000-325479 |
| Nov. 17, 2000 | (JP) | 2000-351440 |

(51) Int. Cl.[7] ..... F02N 11/00
(52) U.S. Cl. ..... 74/7 A; 74/6
(58) Field of Search ..... 74/6, 7 R, 7 A, 74/7 B, 7 C

(56) References Cited

U.S. PATENT DOCUMENTS

| | | | |
|---|---|---|---|
| 3,177,728 | A | 4/1965 | Farison |
| 3,283,595 | A | 11/1966 | Masanori |
| 3,788,151 | A | 1/1974 | Campau |
| 3,955,427 | A | 5/1976 | Squires |
| 4,296,342 | A | 10/1981 | Young et al. |
| 4,353,449 | A | 10/1982 | Lamy et al. |
| 4,579,010 | A | 4/1986 | Colvin et al. |
| 4,779,470 | A | 10/1988 | Morita et al. |
| 4,958,097 | A | 9/1990 | Woodward et al. |
| 5,222,401 | A | 6/1993 | Fasola et al. |
| 5,341,697 | A | 8/1994 | Isozumi |
| 6,202,497 | B1 | 3/2001 | Kuragaki et al. |

FOREIGN PATENT DOCUMENTS

| | | |
|---|---|---|
| EP | 0 349 281 | 1/1990 |
| EP | 0 425 158 | 5/1991 |
| FR | 2 423 650 | 11/1979 |
| GB | 1 519 950 | 8/1978 |
| GB | 2 180 889 | 4/1987 |
| JP | 56-70156 | 11/1954 |
| JP | U-53-157315 | 5/1978 |
| JP | 54-152724 | 12/1979 |
| JP | 8-8040 | 1/1996 |

OTHER PUBLICATIONS

Journal of Nippondenso Technical Disclosure No. 57–057.
Journal of Nippondenso Technical Disclosure No. 55–043.
Journal of Nippondenso Technical Disclosure No. 55–036.

*Primary Examiner*—William C. Joyce
(74) *Attorney, Agent, or Firm*—Oliff & Berridge, PLC

(57) ABSTRACT

A starter for engines uses a leaf spring as a shaft lever for advancing a pinion gear for engagement with a ring gear. The shift lever may be constructed with a plurality of layered leaf springs having respective front ends spaced apart one another to contact a one-way clutch at different positions. The shift lever may include a lever holder which has a low heat conductive member to minimize fatigue of the leaf spring. The leaf spring is initially loaded with a spring force.

2 Claims, 13 Drawing Sheets

STARTER HAVING RESILIENT SHIFT LEVER FOR DRIVING PINION GEAR

CROSS REFERENCE TO RELATED APPLICATION

This is a Division of application Ser. No. 09/759,472 filed Jan. 16, 2001 now U.S. Pat. No. 6,658,949. The entire disclosure of the prior application is hereby incorporated by reference herein in its entirety.

The present application is based on and incorporates herein by reference Japanese Patent Applications No. 2000-7853 filed Jan. 17, 2000, No. 2000-273953 filed Sep. 8, 2000, No. 2000-325479 filed Oct. 25, 2000 and No. 2000-351440 filed Nov. 17, 2000.

BACKGROUND OF THE INVENTION

The present invention relates to improvements in starters, particularly to improvements in a shift lever for driving a pinion gear of a starter.

In a starter disclosed in, for example, Japanese Patent Laid-Open No. 5-180131 and No. 50-65806, a shift lever for driving a pinion gear by an electromagnetic switch is constructed with a resilient drive spring.

The drive spring may comprise two-layered leaf springs supported inclinedly at a middle portion thereof and having contact portions at both ends thereof. However, when the drive spring is operated, loss of kinetic energy by friction is caused because the respective leaf springs slide relative to each other. Therefore, kinetic energy necessary for driving the drive spring is requested to be larger by an amount of the loss by friction and load of an electromagnetic switch is increased by that amount. As a result, the size of the electromagnetic switch is large and heavy, thus consuming larger power.

Further, when a pinion gear is meshed with a ring gear of an engine, return force is exerted to the pinion gear by operation of a helical spline. Therefore, friction heat is generated at an end portion of the shift lever receiving the return force (for example, a portion in contact with a one-way clutch). As a result, there occurs permanent set in fatigue (reduction of resiliency) in the leaf spring by influence of the friction heat.

Moreover, the shift lever has no set load before being brought into contact with a movable cylindrical body including the pinion gear. Since the movable cylindrical body is not kicked impulsively, performance of bringing the pinion gear in mesh with the ring gear becomes insufficient. In the case of the pinion gear and the ring gear fail to mesh each other sufficiently, frictional wear occurs therebetween and the durability becomes insufficient.

SUMMARY OF THE INVENTION

It is therefore an object of the invention to provide a starter capable of improving construction and performance of a shift lever formed by a resilient leaf spring.

According to one aspect of the present invention, a shift lever is constructed with a plurality of leaf springs layered to have gaps at least at end portions thereof where the ends of the springs contact an opposing member such as a movable body of a pinion gear or an electromagnetic switch. As the ends of the springs contact the opposing member at different locations, sliding frictional loss among the springs is minimized.

According to another aspect of the present invention, a shift lever is constructed with a lever holder and a leaf spring. A low heat conductive member is attached to an end portion of the holder so that the low heat conductive member contacts a movable body of a pinion gear. The low heat conductive member suppresses heat transfer between the movable body and the spring at the time of overrun of the pinion gear.

According to a further aspect of the present invention, a shift lever is constructed with a support portion, a lever portion, a leaf spring, and a pin supported by the support portion for pivoting the lever. The lever is constructed to apply a set load to the leaf spring by pinching the leaf spring. Thus, a pinion gear is advanced forward impulsively for engagement with a ring gear of an engine.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

The present invention will be described in detail with reference to various embodiments.

(First Embodiment)

Figure 1:
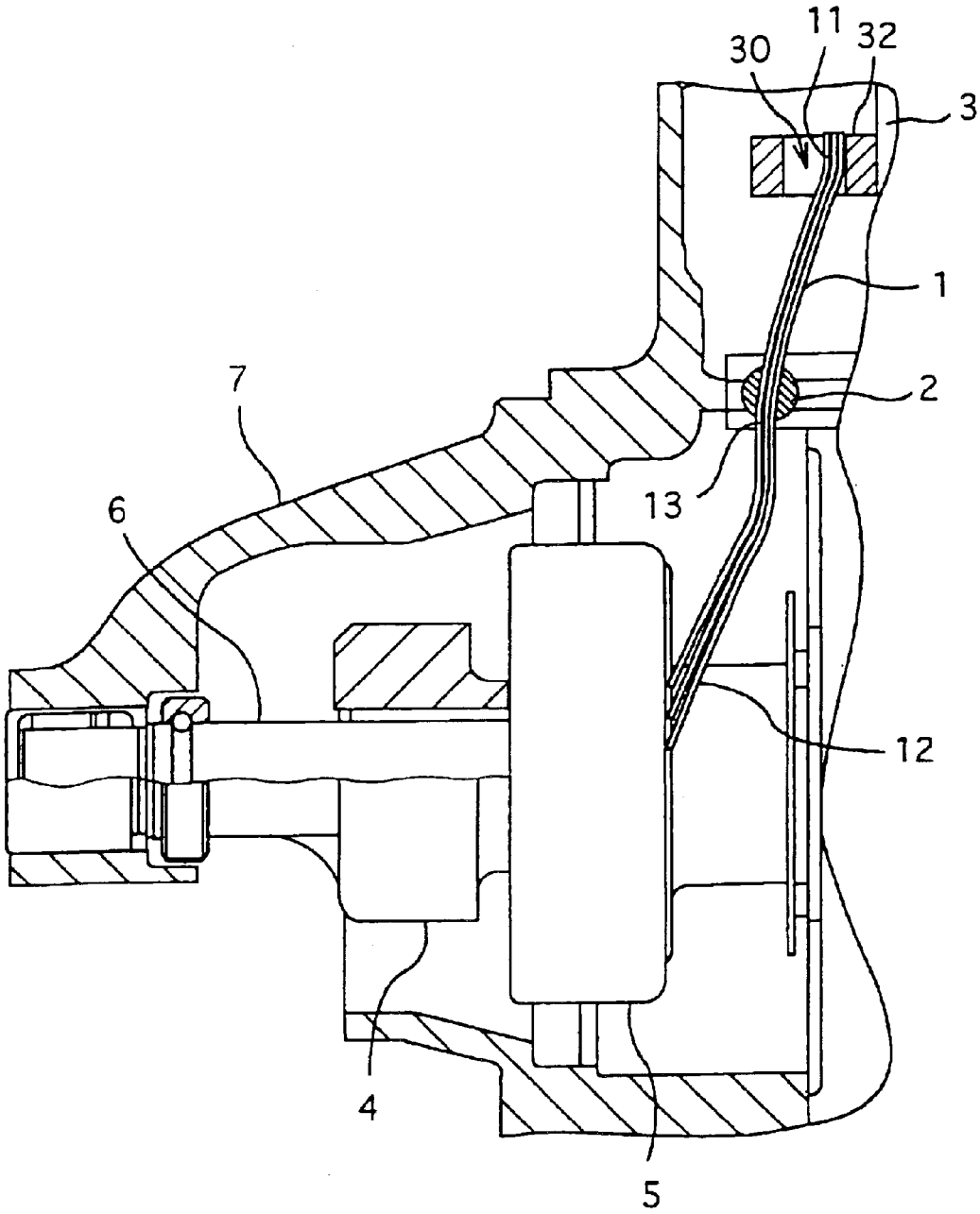
FIG. 1 is a sectional view showing partly a starter according to a first embodiment of the present invention.

Referring first to FIG. 1, a starter includes an electromagnetic switch 3, a unit of a pinion gear 204 and a one-way clutch 5 movable forward and rearward along an axial direction, and a shift lever 1 for driving the unit of pinion gear 204 and clutch 5 by the electromagnetic switch 3.

Figure 2:
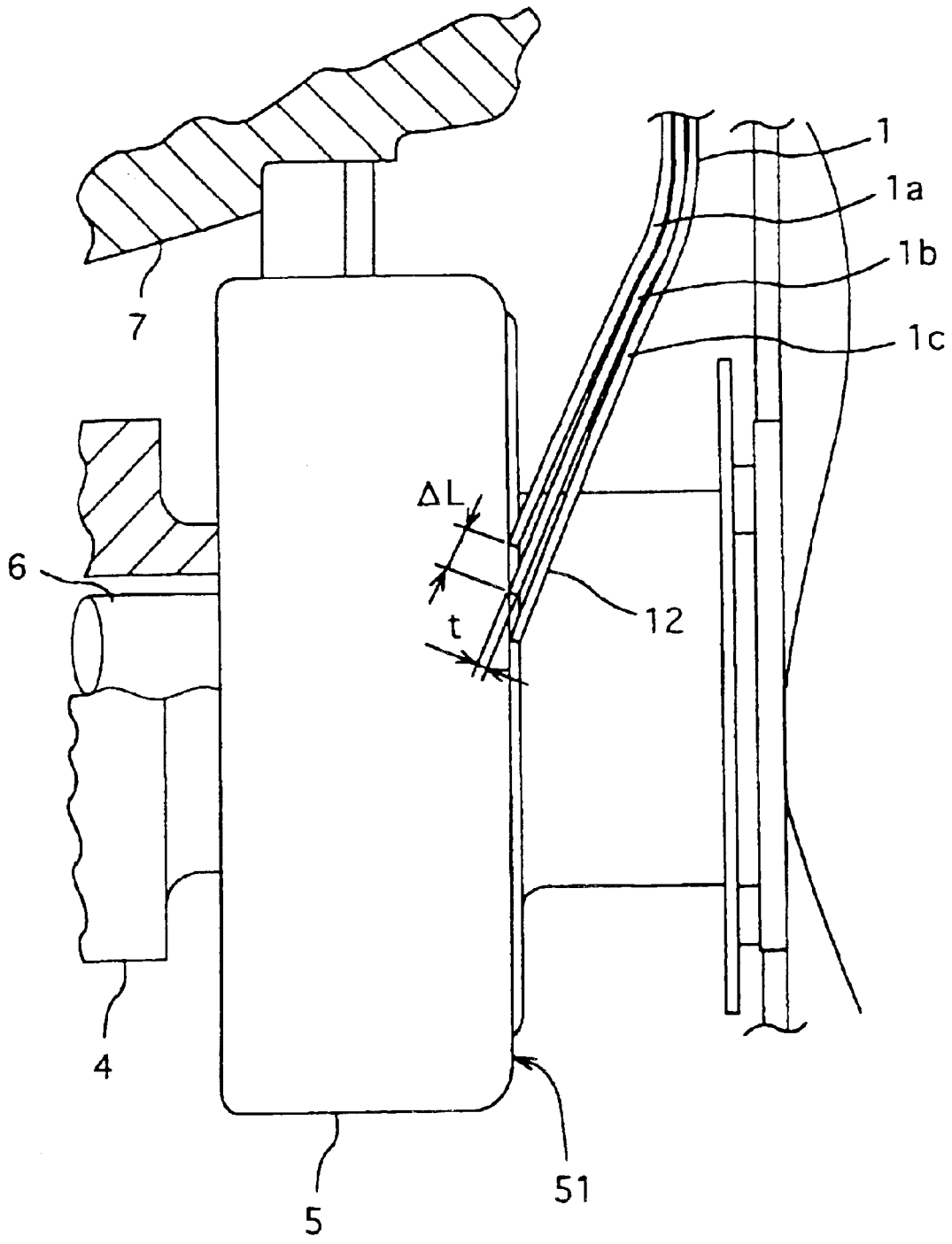
FIG. 2 is an enlarged view showing a shift lever of the starter in the first embodiment.

The shift lever 1 comprises a plurality of, for instance three, sheets of resilient leaf springs 1*a* through 1*c* which are layered as shown in FIG. 2. The shift lever 1 is inclinedly supported at a middle portion 13 thereof and have contact portions at both longitudinal ends 11 and 12 thereof. In this case, the middle portion 13 of the shift lever 1 is held or pinched by a pivot 2 in a cylindrical shape perforated to cross with a through hole and is axially supported to be inclinable in the forward and rearward directions. At the rear end 11 of the shift lever 1, three sheets of the leaf springs 1*a* through 1*c* are aligned with the same length and layered each other to thereby form an end portion. Further, the rear end 11 of the shift lever 1 is inserted into a through hole 30 formed in a plunger front end portion 32 of the electromagnetic switch 3 and follows movement of the plunger front end portion 32 with predetermined play.

Figure 3:
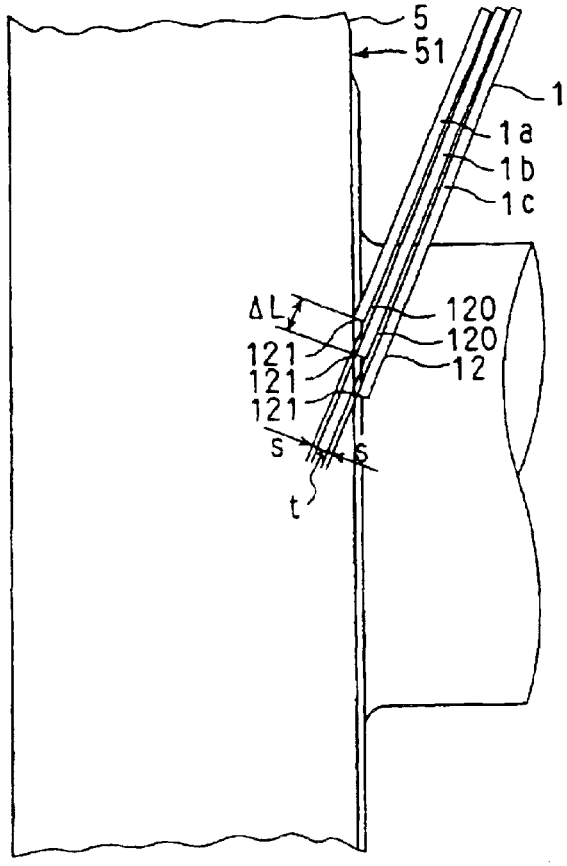
FIG. 3 is an enlarged view showing a slit end of the shift lever in the first embodiment.

As shown in FIG. 3, the front end 12 of the shift lever 1 has a slit portion formed with gaps 120 among the respective leaf springs 1*a* through 1*c* not only at contact portions 121 but up to the vicinity of the middle portion 13 (FIG. 1). At the front end 12, the respective leaf springs 1*a* through 1*c* are provided with differences of front end positions ΔL longer than a thickness "t" of each of the leaf springs 1*a* through 1*c*. With respect to a degree of the difference ΔL, the degree is so large as to form a gap (slit) having a predetermined spacing "s" between contiguous ones of the respective leaf springs 1*a* through 1*c* at the front end 12.

As a result, the leaf springs 1*a* through 1*c* constituting the shift lever 1 are provided with the contact portions 121 in contact with a rear face 51 of the one-way clutch 5 constituting an opposing member at positions of three locations different from each other. Further, grease is coated on the rear face 51 of the one-way clutch 5 with which the front end 12 of the shift lever 1 is brought into sliding contact.

Figure 4:
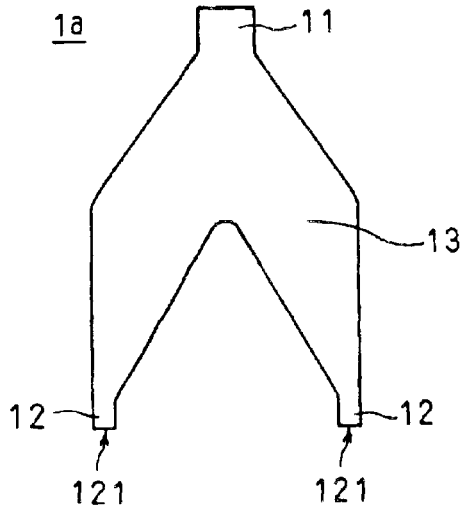
FIG. 4 is a development view showing a shape of one sheet of leaf spring used in the shift lever in the first embodiment.

As representatively shown in FIG. 4 as a development view of the frontmost one of the leaf spring 1*a*, each of the leaf springs 1*a* through 1*c* is a punched-out sheet having substantially a shape of inverse Y and the front end 12 at two locations of lower ends thereof, are brought into contact with the one-way clutch 5 at the contact portions 121. The respective leaf springs 1*a* through 1*c* are made of spring steel material (SK5 or S60CM in JIS standards).

Referring back to FIG. 1, the shift lever 1 is inclinedly supported at the middle portion 13 and the rear end 11 of the shift lever 1 is inserted into the plunger front end portion 32 of the electromagnetic switch 3. Therefore, when the electromagnetic switch 3 is operated and the plunger front end portion 32 is attracted, the shift lever 1 moves forward forwardly the pinion gear 204 and the one-way clutch 5 at the front end 12 while flexing due to spring resiliency.

In this case, the respective leaf spring 1*a* through 1*c* are bundled together at the middle portion 13. Accordingly, significant relative displacement is not caused among contiguous ones of the leaf springs 1*a* through 1*c*. Therefore, at the middle portion 13, even when the respective leaf springs 1*a* through 1*c* are brought into sliding contact with each other, the stroke of the displacement is small. Accordingly, loss of kinetic energy by friction is not caused significantly.

When the electromagnetic switch 3 is operated, bending moment is applied to the shift lever 1 and the respective leaf springs 1*a* through 1*c* flexes and resiliently deforms, at the front end 12 of the respective leaf springs 1*a* through 1*c*, significant relative displacement is caused among the front end 12. Therefore, when the respective leaf springs 1*a* through 1*c* are brought into contact with each other even at the front end 12 of the shift lever 1, friction is caused among the respective leaf springs 1*a* through 1*c* causing loss of kinetic energy.

However, the front end 12 of the shift lever 1 has the gaps 120 among the respective leaf springs 1*a* through 1*c* not only at the contact portions 121 but up to a vicinity of the middle portion 13. Therefore, in the vicinity of the front end 12 having considerable relative displacement, the respective leaf springs 1*a* through 1*c* are not brought into sliding contact with each other and loss of kinetic energy by friction is reduced. As the kinetic energy necessary for driving the shift lever 1 is not increased considerably to compensate for friction loss of the front end 12 of the shift lever 1, the load of the electromagnetic switch 3 is alleviated and the configuration of the electromagnetic switch 3 need not be enlarged considerably.

Further, as shown in FIG. 3, the respective leaf springs 1*a* through 1*c* are respectively provided with the contact portions 121 in contact with the rear face 51 of the one-way clutch 5 at positions different from each other at the front end 12. Accordingly, press force exerted to the contact portions 121 is dispersed when the electromagnetic switch 3 is operated. Oil films are formed at the respective contact portions 121 since grease is coated on the rear face 51 of the one-way clutch 5, at the front end 12, friction force at the contact portions 121 of the shift lever 1 is reduced and friction loss of kinetic energy is further reduced. Further, amounts of wearing the respective contact portions or the opposing member are also reduced.

In the above embodiment, a lever case (not shown) may be provided to contain the front end 12 of the shift lever 1 on the rear side of the one-way clutch 5. The lever case is held rotatably relative to the one-way clutch 5 via a bearing (not shown) and is moved only in the forward and rearward direction. In this instance, wear of the front end 12 is minimized since the front end 12 of the shift lever 1 is contained in the lever case and is not brought into sliding contact with other member.

(Modification of First Embodiment)

Figure 5:
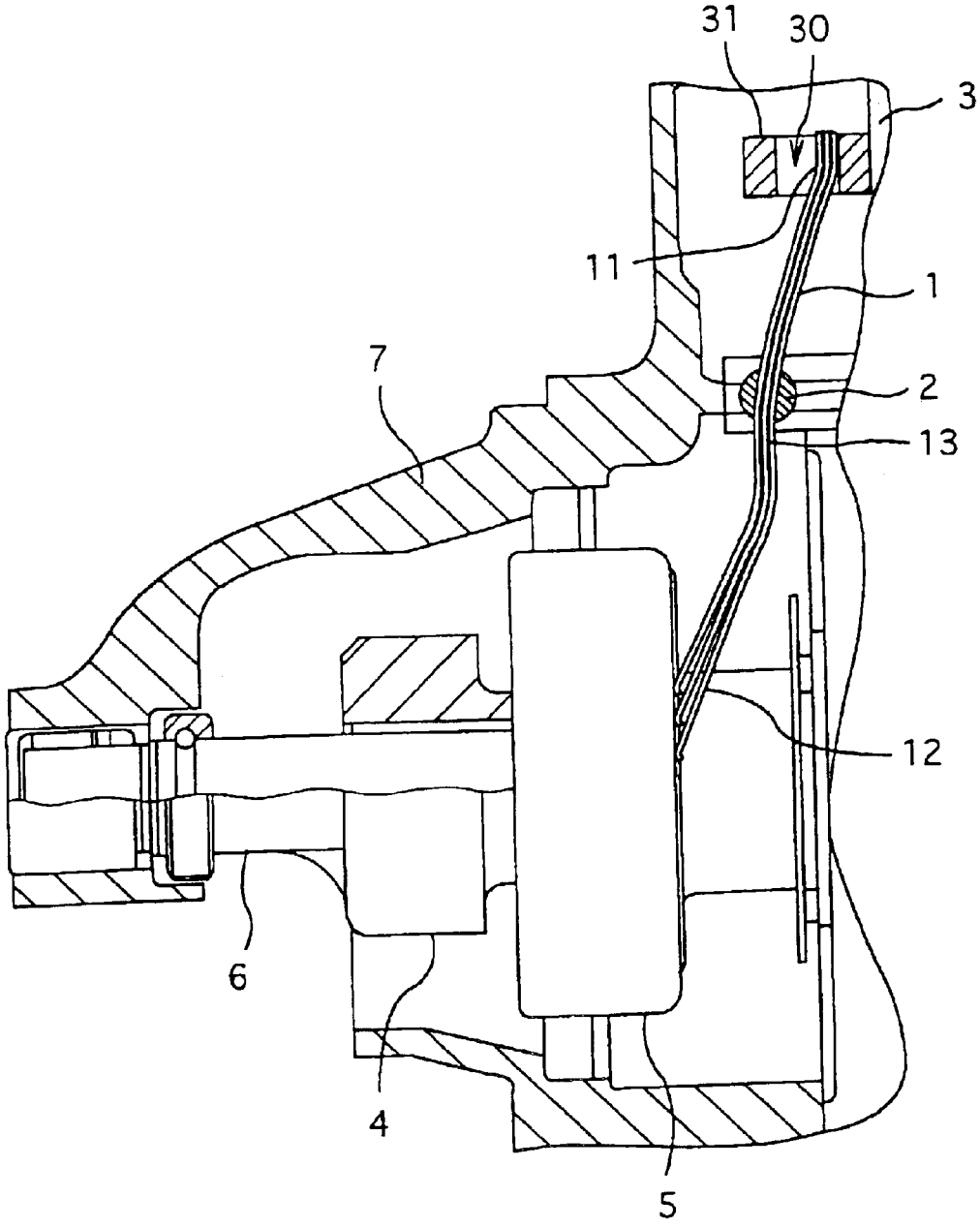
FIG. 5 is a sectional view showing partly a first modification of the shift lever in the first embodiment.
Figure 6:
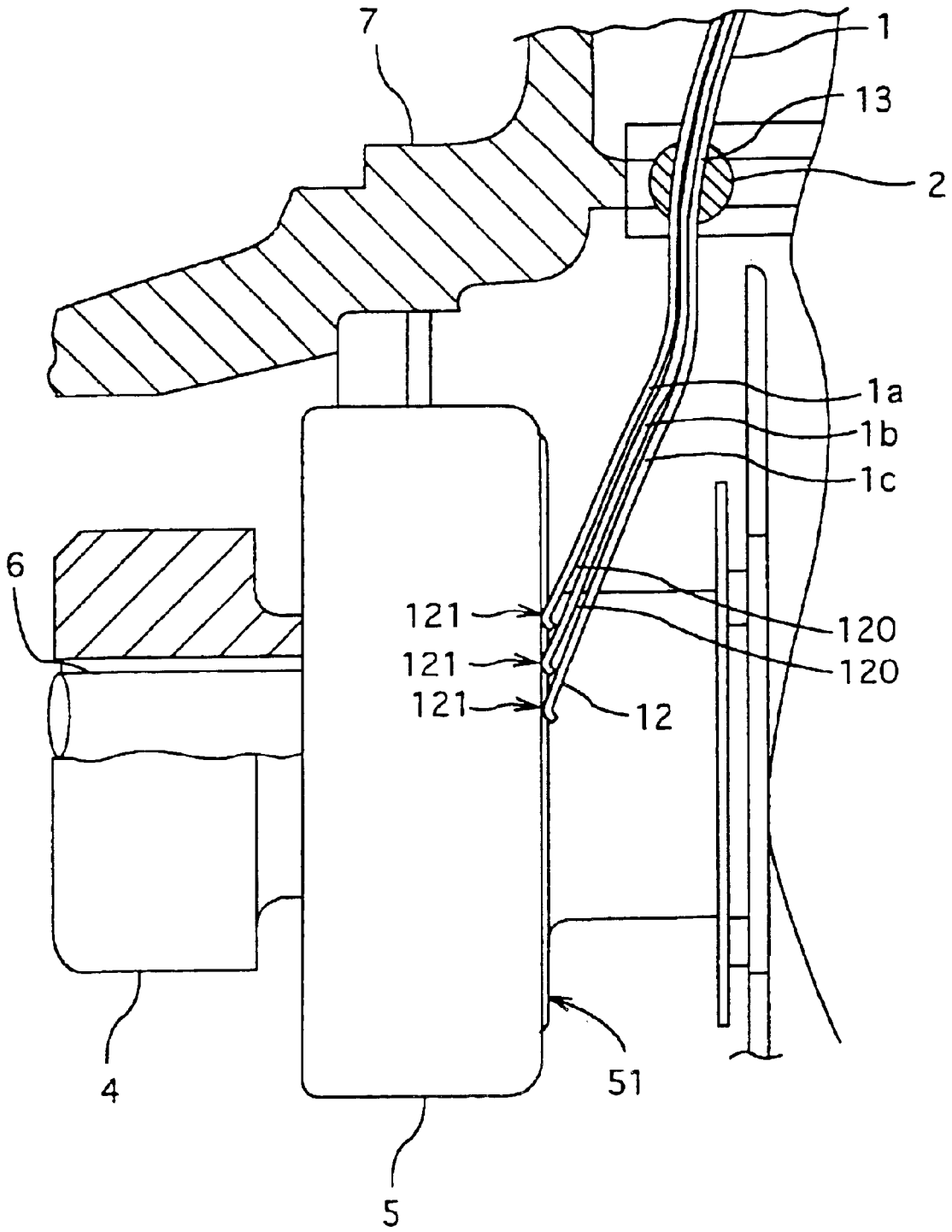
FIG. 6 is an enlarged view showing a slit end of the shift lever in the first modification of the first embodiment.

As shown in FIGS. 5 and 6, the front end 12 forms a slit end portion having large gaps 120 and front end portions 12 of the respective leaf springs 1*a* through 1*c* are bent to fold back rearwardly. Further, as shown in FIG. 6, three sheets of the leaf springs 1*a* through 1*c* constituting the shift lever 1 are respectively provided with contact portions 121 which are brought into contact with the rear face 51 of the one-way clutch 5 by curved faces each having a proper radius of curvature. The slit end portions forming the front end 12 of the shift lever 1 are brought into contact with the rear face 51 of the one-way clutch 5 with the curved faces, and therefore friction and wear at the contact portions 121 are also reduced. That is, since the contact portion 121 of the front end 12 is constructed with the curved face, an oil film of grease is thickly formed between the contact portion 121 and the one-way clutch 5. Pressure between the contact portion 121 of the front end 12 and the one-way clutch 5 is also considerably reduced. Therefore, not only friction resistance is reduced by the oil film but also the contact portion 121 of the front end 12 and the one-way clutch 5 are not directly brought into sliding contact with each other. Accordingly, wear of the contact portion 121 is considerably reduced. As a result, load of the electromagnetic switch 3 for operating the shift lever 1 is further reduced, the electromagnetic switch 3 is further made to be small-sized and light-weighted.

Figure 7:
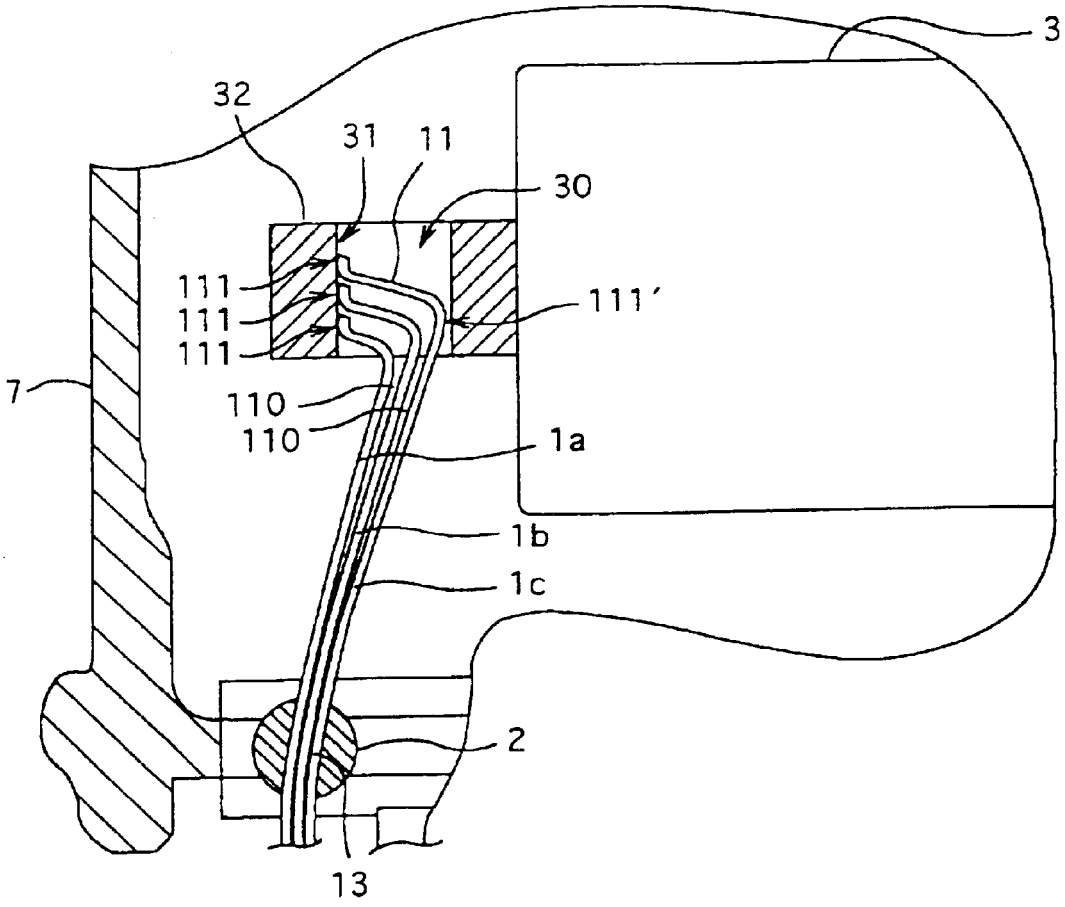
FIG. 7 is an enlarged view showing partly a second modification of the shift lever in the first embodiment.

As a further modification, as shown in FIG. 7, the rear end 11 of the shift lever 1 has a slit end portion forming large gaps 110 among three sheets of the leaf springs 1*a* through 1*c* of the shift lever 1. That is, a rear end of each of the leaf springs 1*a* through 1*c* is respectively press-formed out of an elongated spring steel plate toward its rear side and the rear end 11 of each of the leaf springs 1*a* through 1*c* is bent in a shape of a crank by a predetermined radius of curvature in press-forming thereof. Therefore, not only the rear end 11 of the shift lever 1 is divided into three sheets of the leaf springs 1*a* through 1*c* with gaps there among but also each of the leaf springs 1*a* through 1*c* is brought into contact with a contact face 31 of the plunger front end portion 32 at the contact portion 111 having a curved face.

Thus, loss of kinetic energy by friction is remarkably reduced not only at the front end 12 of the shift lever 1 but also at a vicinity of the rear end 11, and load applied on the electromagnetic switch 3 is reduced.

Further, when the plunger front end portion 32 returns to the original position, there is a case in which the rear end 11 of the shift lever 1 is brought into contact with the plunger front end portion 32 at a contact portion 111' of the rear face of the leaf spring 1*c*. In this case, the contact portion 111' is brought into contact with the plunger front end portion 32 by a curved face. Therefore, wear is reduced and load of a return spring (not shown) is reduced. Accordingly, there also is achieved an effect in which the return spring can be made weak and load of the electromagnetic switch 3 is reduced by that amount.

(Second Embodiment)

Figure 10:
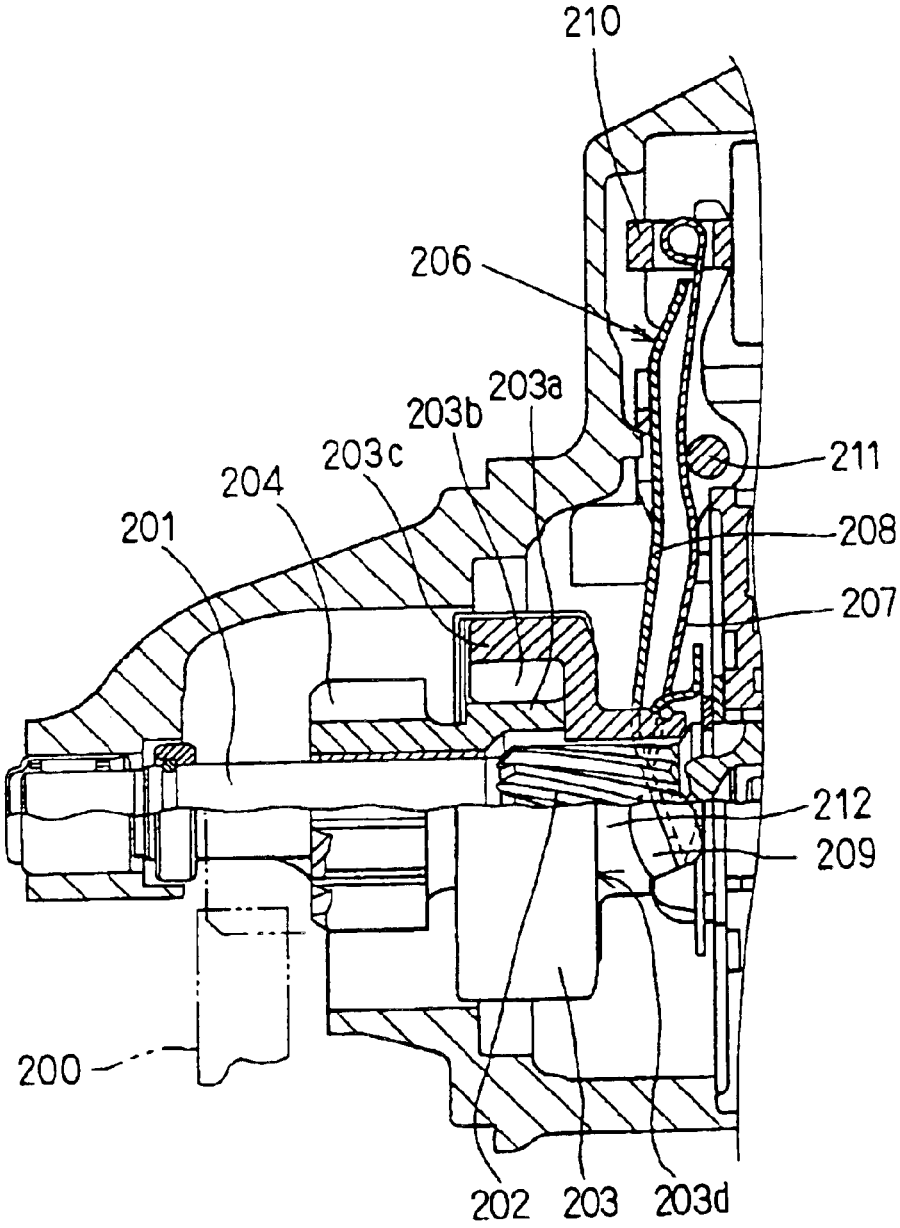
FIG. 10 is a sectional view showing partly a stationary state of the shift lever in the second embodiment.

In a second embodiment, as shown in FIG. 10, a starter includes an output shaft 201 rotated by being transmitted with rotation of a motor armature (not shown), a one-way clutch 203 (inner 203*a*, roller 3*b*, outer 203*c*) fitted to the output shaft 201 via a helical spline 202, a pinion gear 204 transmitted with rotation of the output shaft 201 via the one-way clutch 203, a shift lever 206 for pushing out the pinion gear 204 to a side of a ring gear 200 by receiving attraction force of an electromagnetic switch (not shown), and so on. This starter starts an engine by transmitting rotational force from the pinion gear 204 to the ring gear 200 by bringing the pinion gear 204 move forward via the shift lever 206 in mesh with the ring gear 200 in a known manner.

Figure 8A:
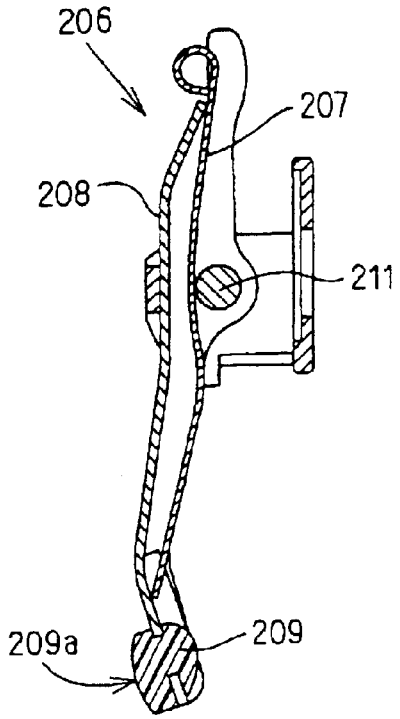
FIGS. 8A and 8B are a sectional view and a front view of a shift lever of a starter according to a second embodiment of the present invention, respectively.
Figure 8B:
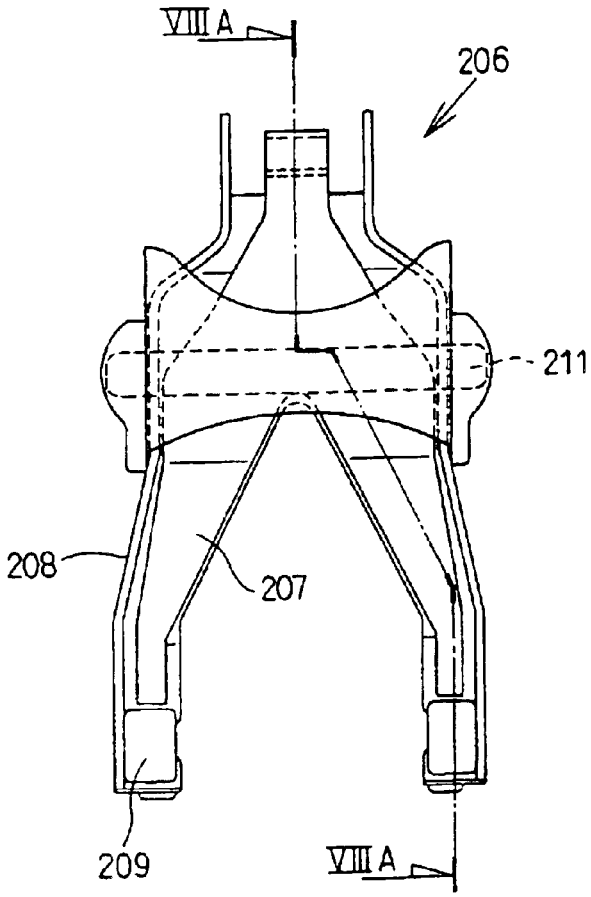

The shift lever 206 is constructed as shown in FIGS. 8A and 8B. Specifically, the shift lever 206 is constructed with a leaf spring 207 made of resilient metal used as a drive spring and a lever holder 208 made of metal for holding the leaf spring 207. The shift lever 206 is provided with a low heat conductive member 209 at a front end (lower end portion) of the lever holder 208.

The leaf spring 207 exerts resilient force to the lever holder 208 by engaging a rear end (upper end portion) thereof with a joint point 210 of an electromagnetic switch and with a support pin 211 as a fulcrum. The lever holder 208 holds to incorporate the leaf spring 207 supported pivotably by the support pin 211 and inserted between the support pin 211 and the lever holder 208. Further, as shown in FIG. 8B, the leaf spring 207 and the lever holder 208 are provided such that lower sides thereof are respectively bifurcated and arranged to ride over a barrel 212 of the one-way clutch 203.

The low heat conductive member 209 is provided at a position which is brought into contact with a rear end face 203*d* of the one-way clutch 203 (FIG. 10) when the pinion gear 204 is moved forward to the side of the ring gear 200 via the shift lever 206. Specifically, as shown in FIG. 8, the low heat conductive members 209 are held at two bifurcated lower end portions of the lever holder 208. The low heat conductive member 209 is molded by, for example, a resin member excellent in wear resistance. It is provided to project to a side forward from a front end face of the lever holder 208 (side of the pinion gear 204) by a predetermined amount in a plate thickness direction (front and rear direction) of the lever holder 208. A front end face 209*a* of the low heat conductive member 209 is constructed with a gradually projected curve face (circular arc face) as shown in FIG. 8A.

Figure 9:
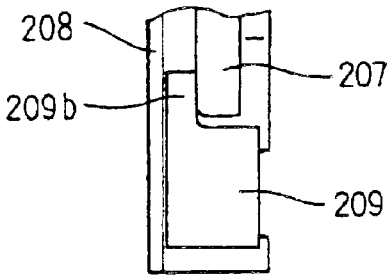
FIG. 9 is a partial view showing the shift lever holding a low heat conductive member in the second embodiment.

Further, the low heat conductive member 209 may adopt a structure in which the low heat conductive member 209 is integrally provided with a lock piece 209*b* and the lock piece 209*b* is supported by the leaf spring 207 as shown in FIG. 9 to prevent detachment from the lever holder 208.

When a starter switch (not shown) is turned on, an inner contact of the electromagnetic switch is closed and electricity is conducted to an armature and the armature starts rotating. Rotation of the armature is transmitted to the output shaft 201 via a speed reduction apparatus (not shown) and transmitted further from the output shaft 201 to the pinion gear 204 via the one-way clutch 203.

Figure 11:
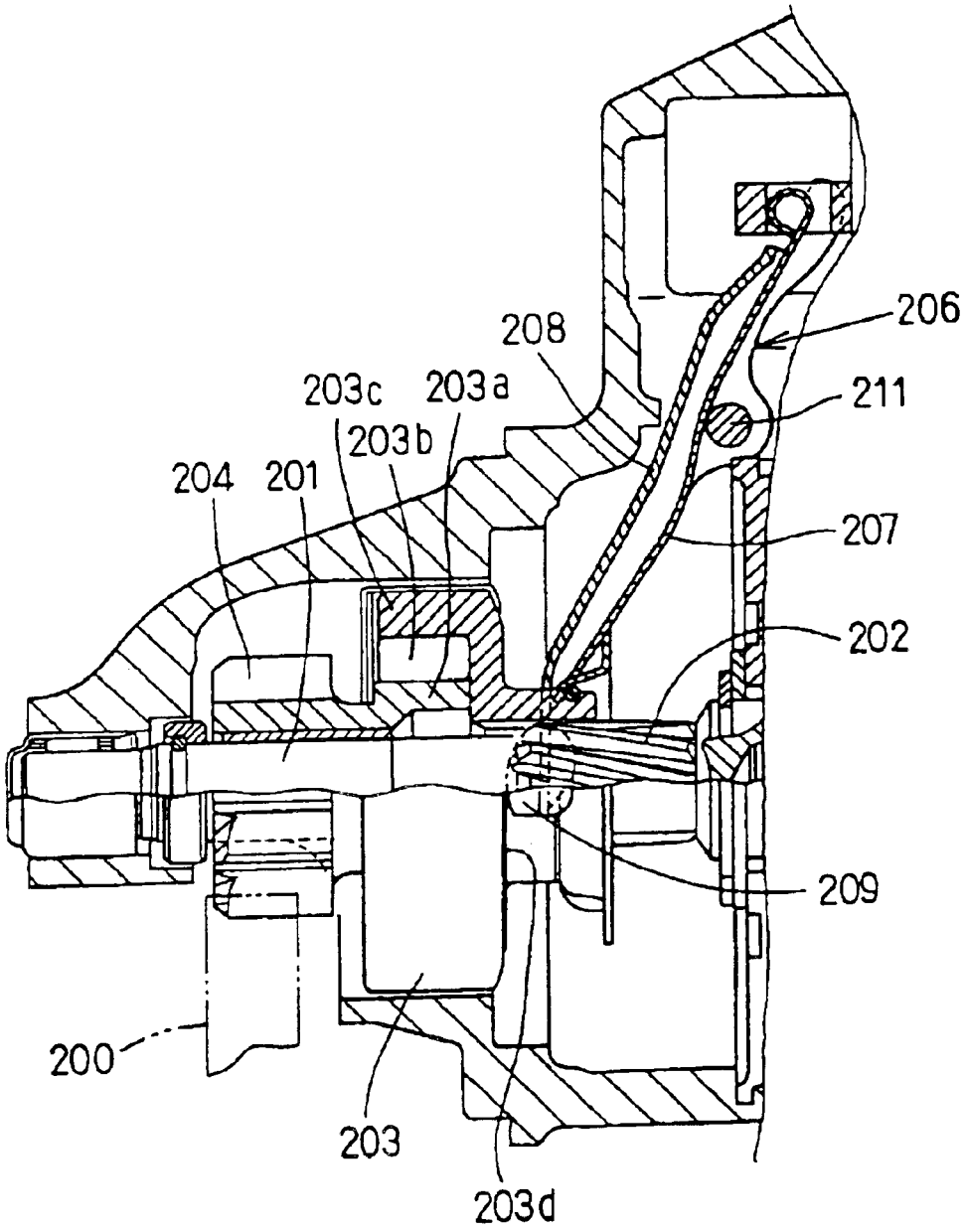
FIG. 11 is a sectional view showing partly an operating state of the shift lever in the second embodiment.

By transmitting attraction force of the electromagnetic switch to the one-way clutch 203 via the shift lever 206, the pinion gear 204 is moved forward to a front side (left direction of FIG. 10) on the output shaft 201 integrally with the one-way clutch 203. The pinion gear 204 is brought in mesh with the ring gear 200 as shown in FIG. 11 to thereby rotate the ring gear 200 and crank the engine.

After starting the engine, when the starter switch is turned off, the attraction force of the electromagnetic switch is nullified. The pinion gear 204 is pulled back on the output shaft 201 integrally with the one-way clutch 203 via the shift lever 206, detached from the ring gear 200 and returns to an initial position shown in FIG. 10. Further, by opening the inner contact of the electromagnetic switch, current to the armature is shut off and rotation of the armature is stopped.

In the above operation, after starting the engine, when the pinion gear 204 is brought into the overrun state while being in mesh with the ring gear 200, in the one-way clutch 203, the inner 203*a* rotated integrally with the pinion gear 204 is idly rotated and idle rotation torque thereof is transmitted to the outer 203*c* via the roller 203*b*. As a result, rotation of the outer 203*c* is converted into force of regressing on the output shaft 201 by operation of the helical spline 202. Accordingly, the pinion gear 204 is exerted with return force. At this occasion, as shown in FIG. 11, the low heat conductive members 209 held at the two lower end portions of the lever holder 208 are brought into contact with the rear end face 203*d* of the one-way clutch 203 and receive the return force of the pinion gear 204. Accordingly, sliding friction is produced between the low heat conductive members 209 and the rear end face 203*d* of the one-way clutch 203.

According to this embodiment, heat generated by the sliding friction is less likely to transmit to metal portions of the shift lever 206 (the helical spring 207 and the lever holder 208). As a result, even when the leaf spring 207 made of metal is used as the drive spring, permanent set in fatigue of the leaf spring 207 caused by influence of heat can be restrained and a deterioration in the spring function can be prevented. Particularly, when the engine rotational number in starting is increased by promotion of the ignitability, the return force of the pinion gear 204 received by the shift lever 206 is increased, friction heat generated by the sliding friction is also increased. Therefore, an effect of providing the low heat conductive members 209 at the end portions of the lever is also increased.

Further, since permanent set in fatigue of the leaf spring 207 by heat can be reduced, an effect of using the leaf spring 207 (capable of shortening the shaft length of the starter) can be achieved and a starter which is small-sized and having stable service life can be provided.

(Modification of Second Embodiment)

The shift lever 206 may be applied to a starter having a structure in which the one-way clutch 203 is arranged on the rear side of the shift lever 206 and the pinion gear 204 is moved on the output shaft 201 by itself. Further, the shift lever 206 may be constructed with a single or a plurality of the leaf springs 207, and the low heat conductive members 209 are provided at end portions of the leaf spring 207.

(Third Embodiment)

Figure 12:
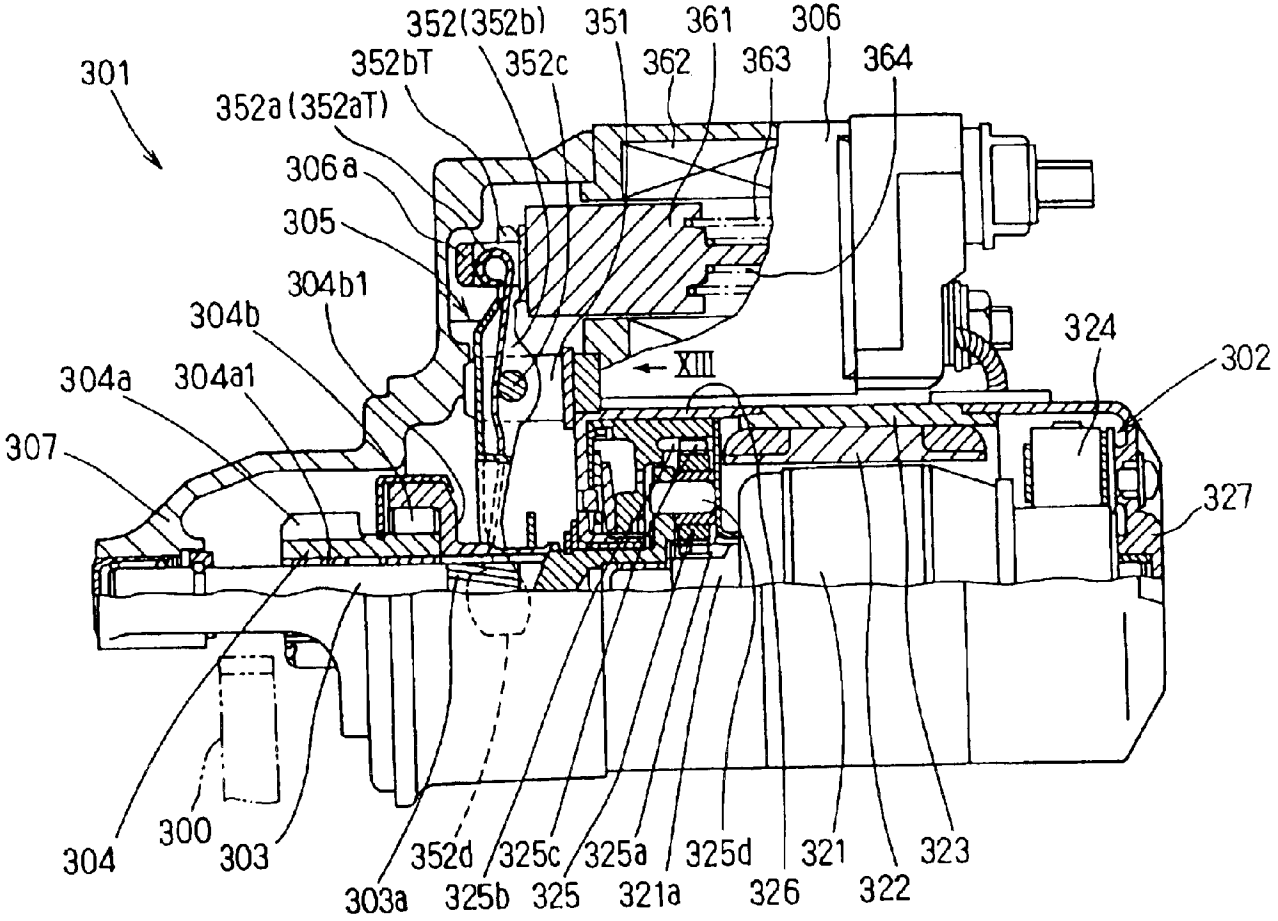
FIG. 12 is a sectional view showing a starter according to a third embodiment of the invention.

In a third embodiment, as shown in FIG. 12, a starter 301 is constructed to include a starter motor 302 for generating rotational force by receiving electricity conduction, an output shaft 303 arranged coaxially with a rotating shaft of the starter motor 302, a movable cylindrical body 304 fitted to a helical spline 303*a* of the output shaft 303 and movable forward and rearward in an axial direction along the helical spline 303*a*, a restricting member 305 for kicking out the movable cylindrical body 304 to advance by a predetermined amount by bringing a pinion gear 304*a* in mesh with a ring gear 300 while restricting the movable cylindrical body 304 from retreating in order to bring a teeth portion (pinion gear) 304*a* of the movable cylindrical body 304 in mesh with the ring gear 300 of the engine, and drive unit 306 for pushing out a lever 352 of the restricting member 305 in a direction to a side of the movable cylindrical body 304. The lever 352 is used to generate a spring force.

The starter motor 302 is a direct current motor constructed to include an armature 321, a fixed electromagnetic pole 322, a yoke 323 and a brush 324. When a key switch (starter switch not shown) is turned on and an inner contact (not shown) of the electromagnetic switch 306 is closed, electric power is fed to the armature 321 via the brush 324 and the armature 321 is rotated.

Further, the starter 301 is provided with a speed reduction device 325 for transmitting rotational force of the starter motor 302 to the output shaft 303. The speed reduction device 325 is constructed with a sun gear 325*a* forming outer teeth at an outer periphery of an armature shaft 321*a*, an internal gear 325*b* in a ring-like shape forming inner teeth in a diametric direction of the sun gear 325*a* and planetary gears 325*c* arranged between the sun gear 325*a* and the internal gear 325*b* to be in mesh with the two gears 325*a* and 325*b* and by revolving the planetary gears 325*c* while being rotated at an outer periphery of the sun gear 325*a*, revolution of the planetary gears 325*c* is transmitted to the outer shaft 303 via pins 325*d*. The speed reduction device 325 is contained along with the armature 321 by the yoke 323 and a center case 326 and an end cover 327 arranged and fixed on a front side and a rear side of the yoke 323.

The movable cylindrical body (pinion gear) 304 is constructed with including the pinion gear 304*a* to be in mesh with the ring gear 300 of the engine and a one-way clutch 304*b* fitted to the helical spline 303*a* of the output shaft 303 and movable forward and rearward in the axial direction along the helical spline 303*a*.

That is, the one-way clutch 304*b* is provided movably in the forward and rearward direction on the output shaft 303 integrally with the cylindrical movable body 304 by being helical spline-fitted to the outer periphery of the output shaft 303 slidably via the helical spline 303*a*. The pinion gear 304*a* is fitted slidably to the outer periphery of the output shaft 303 via a bearing 304*a*1, move forward on the output shaft 303 integrally with the one-way clutch 304*b* via the lever 352 and brought in mesh with the ring gear 300 to thereby transmit rotational force to the ring gear 300. Meanwhile, the one-way clutch 304*b* transmits rotation of the output shaft 303 to the pinion gear 304*a* and blocks power transmission between the output shaft 303 and the pinion gear 304*a* when rotational speed of the pinion gear 304*a* exceeds rotational speed of the output shaft 303 by starting the engine.

The restricting member (shift lever device) 305 is constructed with a support portion 351, the lever 352 supported by the support portion 351 and having a leaf spring 352*a* and a pin 352*c* supported by the support portion 351 for pivoting the lever 352. In the shift lever device 305, one side of the lever 352 is arranged to be capable of transmitting reciprocal movement of a movable portion 306*a* in the axial direction to the cylindrical movable body 304 by being brought into contact with the movable portion 306*a* of the drive unit 306 with the support portion 351 as a fulcrum and other side thereof is arranged to be capable of moving to a contact face 304*b*1 of the cylindrical movable body 304 with the support portion 351 as a fulcrum by operating the drive unit 306 when the engine is started. Further, as shown in FIG. 12, the shift lever device 305 is contained in a front cover 307 and incorporated in the starter 301 along with the drive unit 306, the starter motor 302 and the output shaft 303 rotated integrally with the starter motor 302.

The driving device (electromagnetic switch) 306 is constructed with including a plunger 361, a coil 362 and an inner contact (not shown). The plunger 361 is provided with a return spring 363 for urging the plunger 361 to a side of the lever 352 when electricity is not conducted to the coil 362. When the electromagnetic switch 306 is brought into an operating state, that is, when electricity is conducted to the coil 362 and attraction force is generated, the built-in plunger 361 is moved in the right direction of FIG. 12. In accordance with movement of the plunger 361, the inner contact is opened and closed, the movable portion 306*a* capable of being brought into contact with the lever 352 of the shift lever device 305 is moved in the forward and rearward direction (left and right direction in FIG. 12) integrally with the plunger 361 to thereby move the cylindrical movable body 304 in the forward and the rearward direction (left and right direction in FIG. 12) on the output shaft 303 via the lever 352.

Further, the movable portion 306*a* is provided at a front end of the plunger 361 on the side of the lever 352. Further, the plunger 361 is provided with a contact spring 364 for applying set load to a movable cylindrical body contact (not shown) of the inner contact for movably arranging a plunger end portion 361*b* in the axial direction.

In this embodiment, when electricity is conducted to the coil 362 built in the electromagnetic switch 306 by operation of turning on the key switch (starter switch), the plunger 361 is attracted in the right direction in FIG. 12. The movable portion 306*a* is brought into contact with the lever 352 supported by the support portion 351 of the shift lever device 305 and moves the cylindrical movable body 304 by a predetermined amount in accordance with an amount of moving the plunger 361. That is, when the electromagnetic switch 306 is operated, the pinion gear 304*a* is moved forward on the output shaft 303 integrally with the one-way clutch 304*b* via the lever 352. Thereby, the cylindrical movable body 304 advances and is brought into contact with the ring gear 300.

Next, by contacting the pinion gear 304*a* to the ring gear 300, the plunger is moved further in the right direction and closes the inner contact of the drive unit 306 via the lever 352. When the inner contact is closed, the armature 321 is conducted with electricity and rotated and rotation of the armature 321 is decelerated by the speed reduction device 325 and is transmitted to the output shaft 303.

Rotation of the output shaft 303 is transmitted to the pinion gear 304*a* in contact with the ring gear 300. When the pinion gear 304*a* is rotated up to a rotational angular position capable of being brought in mesh with the ring gear 300, the pinion gear 304*a* is moved forward impulsively by spring force of the leaf spring 352*a* held in the lever 352. Accordingly, the pinion gear 304*a* can be brought into mesh with the ring gear 300. Thereby, rotation of the pinion gear 304*a* is transmitted to the ring gear 300 to thereby start the engine.

Next, after starting the engine, when electricity conduction to the coil 362 of the electromagnetic switch 306 is stopped by operation of turning off the key switch, the plunger 361 which has been attracted, returns to an initial position by urge force of the return spring 363. Thereby, the lever 352 regresses in the right direction in FIG. 13. At this occasion, the pinion gear 304*a* is brought into a state of being detachable from the ring gear 300 since nothing restricts regression thereof. Therefore, by operation of the one-way clutch 304*b*, the pinion gear 304*a* is detached from the ring gear 300 integrally with the one-way clutch 304*b* and retreats on the output shaft 303. Further, by opening the inner contact of the electromagnetic switch 306, electricity conduction to the armature 321 is stopped to thereby stop rotation thereof.

Figure 13B:
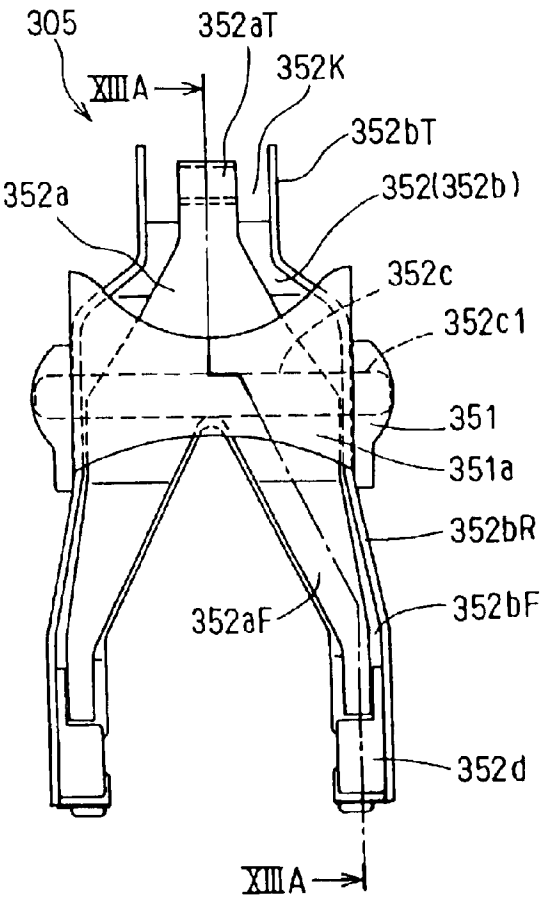
FIGS. 13A and 13B are a sectional view and a front view of a shift lever of the starter in the third embodiment, respectively.
Figure 13A:
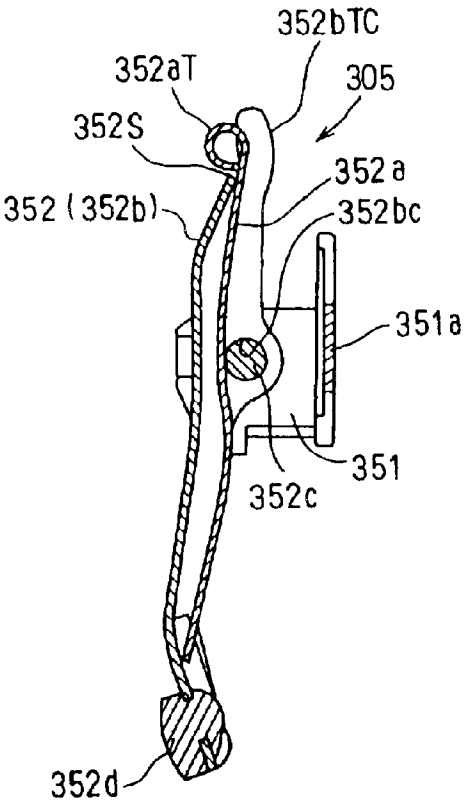

As shown in FIG. 13A, the shift lever device 305 is constructed with the support portion 351, and the lever 352 supported by the support portion 351 and having the leaf spring 352*a*. The lever 352 is constructed with the leaf spring 352*a*, a lever holder 352*b* for holding the leaf spring and a pin 352*c* for pinching the leaf spring 352*a* along with the lever holder 352*b*. The shift lever 352 operates as a spring force generating member S.

The lever holder 352*b* is formed by a metallic material, and provided with rib portions 352*b*R extended in the axial direction of the starter 301 to surround the leaf spring 352*a*. That is, the lever holder 352*b* is formed by a metallic material and is provided with the rib portions 352*b*R for containing the leaf spring 352*a*.

As shown in FIG. 13B, to restrict rotation of the pinion gear 304*a*, one side of the lever holder 352*b* on the side of the pinion gear 304*a* is provided with bifurcated portions 352*b*F having two pieces of contact portions 352*d*, which are brought into contact with an outer peripheral side of the contact face 304*b*1 of the pinion gear 304*a* and formed to divide in a bifurcated shape. Further, as shown in FIG. 13B, other side thereof on the side of the electromagnetic switch 306, is provided with a notched portion 352K such that the movable portion 306*a* of the electromagnetic switch 306 and the leaf spring 352*a* can be brought into contact with each other.

When the pinion gear 304*a* is stationary, that is, before the electromagnetic switch 306 moves the shift lever device 305 to the pinion gear 304*a*, rib portions (corner portions) 352*b*T forming the notched portion 352K, are brought into contact with the plunger 361 such that the leaf spring 352*a*, that is, a contact portion 352*a*T is not brought into contact with the movable portion 306*a*. Therefore, the leaf spring 352*a* is released in bringing the pinion gear 304*a* in mesh with the ring gear 300, or when the movable portion 306*a* returns after bringing the pinion gear 304*a* in mesh with the ring gear 300, load applied on the leaf spring, or impact load can be restrained and received by the corner portions 352*b*T of the lever holder 352*b*. Thereby, breakage of the shift lever device 305, particularly, the leaf spring 352*a* by the impact load can be prevented.

The leaf spring 352*a* is formed by a spring member and an outer shape thereof is formed to align with the rib portions 352*b*R containing the leaf spring 352*a* of the lever holder 352*b* and is provided with bifurcated portions 352*a*F in correspondence with the bifurcated portions 352*b*F of the lever holder 352*b*.

Further, as shown in FIG. 13A, it is preferable to form the contact portion 352*a*T in contact with the movable portion 306*a* by bending a leaf spring. Thereby, the contact portion 352*a*T of the leaf spring 352*a* is less likely to be brought into partial contact with a contact face of the movable portion 306*a* of the electromagnetic switch 306. Accordingly, when the movable portion 306*a* is moved in the right direction in FIG. 12 by operating the electromagnetic switch 306, the movable portion 306*a* can advance stably and smoothly toward the pinion gear 304*a* of the lever 352 to be engaged with the movable portion 306*a*. Further, face contact can be carried out by the bent contact portion 352*a*T. Accordingly, the movable portion 306*a* and the contact portion 352*a*T can achieve promotion of reliability in the wear resistance.

The pin 352*c* is formed as a supporting member of a metallic material, arranged in a direction orthogonal to the output shaft 303 and is fixed to the lever holder 352*b* to penetrate the rib portions 352*b*R of the lever holder 352*b*. Pin end portions 352*c*1 projected from the lever holder 352*b* are supported by the support portion 351 as fulcrums of the lever 352. Thereby, the pin 352*c* is supported by the support portion 351, makes the lever 352 pivotable and pinches the leaf spring 352*a* by the pin 352*c* and the lever holder 352*b*. The leaf spring 352*a* can be provided with set load. That is, by using the pin 352*c* constituting an operating member for applying set load to the leaf spring 352*a*, the pin 352*c* also serves as the pin end portions 352*c*1 supported by the support portion 351. Accordingly, the construction can be simplified and downsizing of the starter 301, particularly, downsizing of the lever 352 can be carried out. The support portion 351 is formed by a resin member and supports the lever 352 constructed as described above with the pin 352*c* as the fulcrum.

When the lever holder 352*b* and the pin 352*c* for applying set load to the leaf spring 352*a* are subjected to material improvement or surface hardening by heat treatment, an increase in strength thereof can be achieved without enlarging configuration thereof. Therefore, a range of setting the set load to the leaf spring 352*a* can be enlarged. That is, the lever holder 352*b* and the pin 352*c* are formed by a metallic material. Accordingly, increase of strength by heat treatment can be carried out to provide desired set load. Therefore, it is not necessary to select means for enlarging configurations of the lever holder 352*b* and the pin 352*c* for increasing strength. Therefore, the configuration can be downsized in comparison with a material which cannot adopt means for increasing strength by material improvement or surface hardening by heat treatment as in a resin material.

Further, as means for fixing the pin 352*c* to the lever holder 352*b*, without using a bonding member of welding, the pin 352*c* can firmly be fixed by press-fitting the pin 352*c* into through holes 352*bc* of the lever holder 352*b*.

Further, the leaf spring 352*a* of the lever 352 is provided with the bifurcated portions 352*a*F. Thereby, the leaf spring 352*a* can be prolonged. When set load is applied to the leaf spring 352*a*, an amount of deformation produced by applying load can be increased in accordance with the length. That is, the pin 352*c* for applying set load to the leaf spring 352*a* can be made to be easy to pinch the leaf spring 352*a*.

An explanation will be given of a characteristic of promoting performance of bringing the pinion gear 304*a* and the ring gear 300 in mesh with each other by impulsively kicking the pinion gear 304*a* by using spring force of set load of the lever 352 by the shift lever device 305.

Figure 14B:
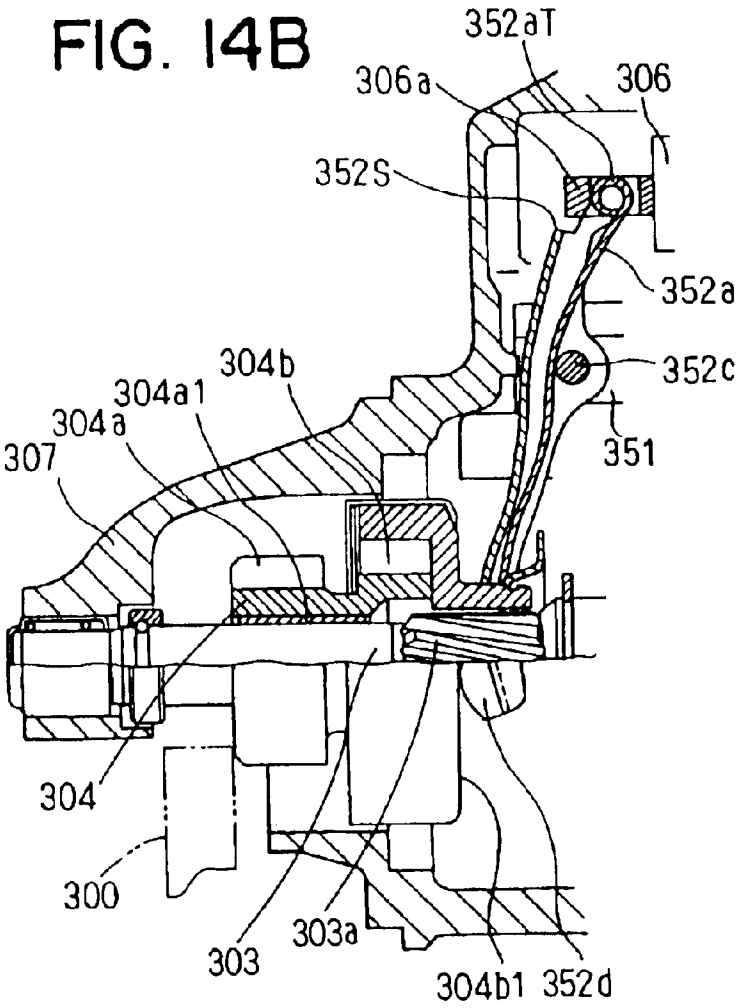
FIGS. 14A and 14B are sectional views showing partly an operating state and a stationary state of the shift lever in the third embodiment, respectively.
Figure 14A:
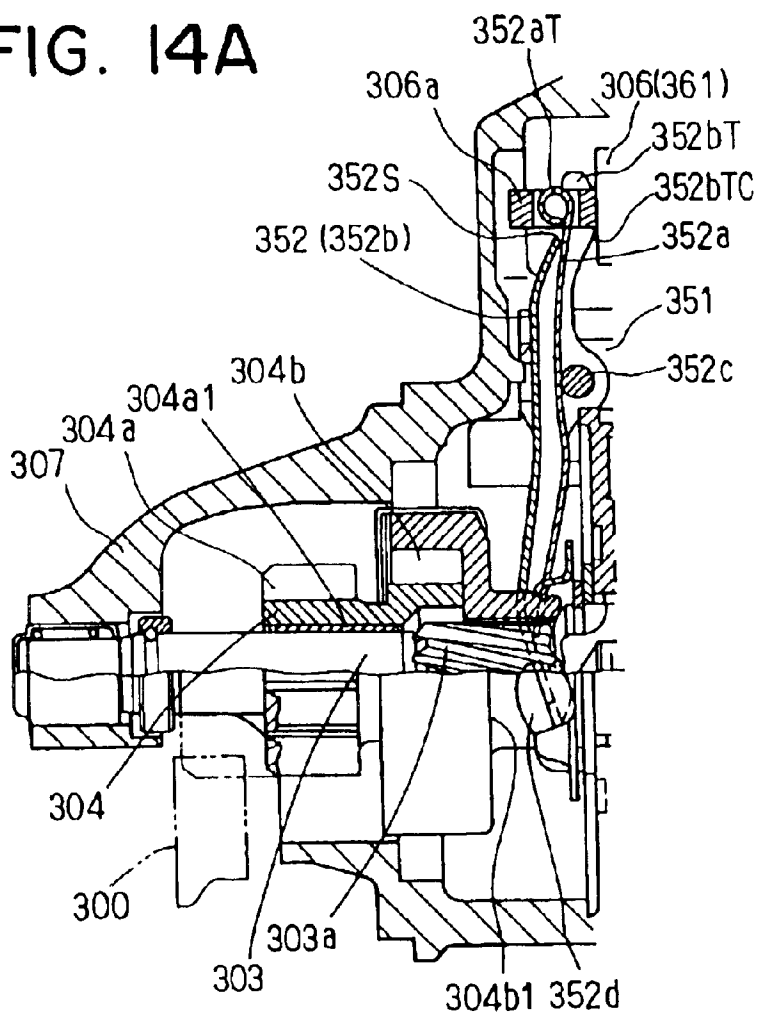

FIG. 14A is a schematic sectional view showing states of the lever 352 in which electromagnetic switch 306 is in an OFF state. FIG. 14B is a schematic sectional view showing a state of the lever 352 in which the electromagnetic switch 306 is in the ON state.

As shown in FIG. 14A, in the state in which the electromagnetic switch 306 is not operated, the lever 352 supported by the support portion 351 is arranged vertically with the pin 352*c* as a fulcrum. Since the leaf spring 352*a* is applied with set load, it is not necessary to bend the leaf spring 352*a* by bringing the movable portion 306*a* into contact with the leaf spring 352*a* of the lever 352. Therefore, it is not necessary to bring the leaf spring 352*a*, that is, the lever 352 into contact with the movable portion 306*a* and the lever 352 may be brought into contact therewith or may be disposed in the vicinity of the movable portion 306*a* without being brought into contact therewith.

When the key switch is brought into the ON state, that is, the electromagnetic switch 306 is brought into the ON state, as shown in FIG. 14B, the electromagnetic switch 306 is brought into an operating state. That is, the movable portion 306*a* is moved in the right direction integrally with the plunger 361 from a state of FIG. 14A to a state of FIG. 14B. At this occasion, the contact portion 352*a*T of the leaf spring 352*a* contained in the lever 352 of the shift lever device 305, is brought into contact with the movable portion 306*a*. When the movable portion 306*a* is further moved in the right direction, the contact portions 352*d* of the lever 352 supported by the support portion 351 are moved by a predetermined amount to the side of the contact face 304*b*1 of the pinion gear 304*a* in accordance with an amount of moving the movable portion 306*a*. The contact portion 352*d* is brought into contact with the contact face 304*b*1 and moves forward and makes the pinion gear 304*a* of the cylindrical body 304 advance to be brought into contact with the ring gear 300. That is, the pinion gear 304*a* is moved forward on the output shaft 303 and is brought into contact with the ring gear 300.

When the pinion gear 304*a* moves forward via the lever 352 and comes into contact with the ring gear 300, the movable portion 306*a* with which the contact portions 352*d* formed at the leaf spring 352*a* of the lever 352 are brought into contact, that is, the plunger 361 moves further in the right direction against set load of the lever 352 and closes the inner contact of the electromagnetic switch 306.

Further, when the inner contact is closed, the armature 321 is conducted with electricity and rotated and rotation of the armature 321 is decelerated by the speed reduction device 325 and is transmitted to the output shaft 303. Rotation of the output shaft 303 is transmitted to the pinion gear 304*a* in contact with the ring gear 300. At this occasion, as shown in FIG. 14B, the pinion gear 304*a* is applied with spring force in correspondence with load added with set load of the leaf spring 352*a* of the lever 352 which is detached from a set load operating point 352S of the lever holder 352*b* and is further bent, and load of a set amount. Therefore, when the pinion gear 304*a* is rotated up to a rotational angular position capable of being brought in mesh with the ring gear 300, the pinion gear 304*a* is moved forward impulsively in the left direction of FIG. 14B by the spring force in correspondence with the load added with the set load and the load of the bent amount.

That is, by operating the electromagnetic switch 306, the pinion gear 304*a* can be move forward impulsively by the spring force of the lever 352, that is, the shift lever device 305 provided with the spring force in correspondence with the load added with the load of the bent amount by which the lever 352 in contact with the movable portion 306*a* is detached from the load operating point 352S and bent in accordance with the predetermined amount of moving until the lever 352 contacting with the movable portion 306*b* brings the pinion gear 304 into contact with the ring gear 300, and the set load. Thereby, the performance of bringing the pinion gear 304*a* in mesh with the ring gear 300 can be promoted. Therefore, the pinion gear 304*a* and the ring gear 300 are brought in mesh with each other without being brought into mesh with each other insufficiently and the engine can be started swiftly.

Further, as urging means for moving the plunger 361 further in the right direction after the pinion gear 304*a* has been brought into contact with the ring gear 300 and closing the inner contact of the electromagnetic switch 306, by using the set load of the lever 352, it is not necessary to include urging means (drive spring) for urging the plunger 361 arranged in the plunger 361 in the right direction. Accordingly, as shown in FIG. 12, the plunger 361 can be formed in a cylindrical shape which is not hollow. Therefore, by using the lever 352 having the set load of the leaf spring 352*a*, downsizing of the plunger 361 of the electromagnetic switch 306, that is, downsizing of the starter 301 can be carried out.

(Modification of Third Embodiment)

Figure 15B:
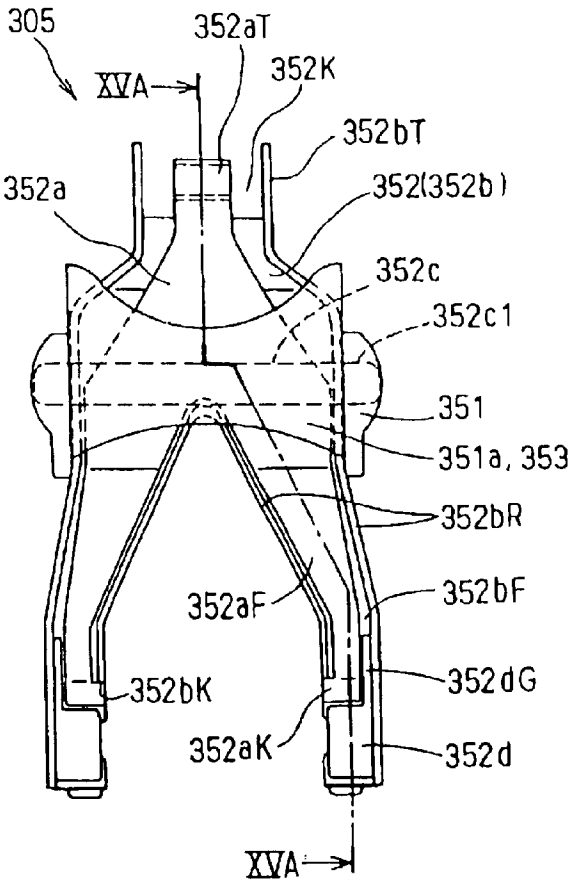
FIGS. 15A and 15B are a sectional view and a front view of a shift lever of the starter according to a modification of the third embodiment, respectively.
Figure 15A:
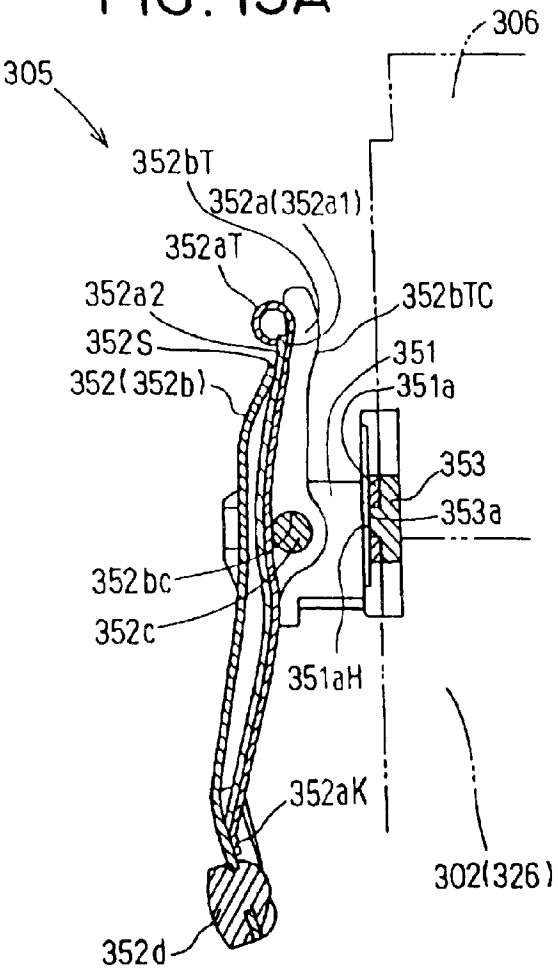

As shown in FIG. 15A, the leaf spring 352*a* is layered with a plurality of spring members (layered with two sheets of spring members in FIG. 15A), and the contact portion 352*a*T in contact with the movable portion 306*a* of the electromagnetic switch 306 is formed by bending a spring member 352*a*1 in two sheets of spring members 352*a*1 and 352*a*2. Thereby, the spring characteristic of the leaf spring 352*a* can be adjusted by combining to select plate thickness of the spring members 352*a*1 and 352*a*2. Therefore, there can be suppressed a dispersion in respective products of the spring force of impulsively kicking the pinion gear 304*a*. Therefore, desired spring force can be set and the performance of bringing the pinion gear 304*a* and the ring gear 300 in mesh with each other can further be promoted.

The contact portion 352*a*T in contact with the electromagnetic switch 306 of the leaf spring 352*a* is formed by bending one sheet of the spring member 352*a*1 in the leaf spring layered with the spring members 352*a*1 and 352*a*2. Accordingly, it is easy to bend the contact portion 352*a*T by press-forming and fabrication cost can be reduced. Therefore, stability of operation of advancing the lever 352 of the pinion gear 304*a* by using the electromagnetic switch 306 as well as promotion of reliability of wear resistance of the movable portion 306*a* of the electromagnetic switch 306 and the contact portion 352*a*T of the lever 352.

Further, as shown in FIG. 15B, the leaf spring 352*a* is provided with projected portions 352*a*K locked by notched portions 352*b*K of the lever holder 352*b*. Accordingly, an integration operation of applying set load to the leaf spring 352*a* by pinching the leaf spring 352*a* by the lever holder 352*b* and the pin 352*c*, the leaf spring 352*a* and the lever holder 352*b* are less likely to shift from each other. Thus, the integration operation of integrating the pin 352*c* to the lever holder 352*b* can be facilitated. Further, it is preferable to provide the projected portions 352*a*K at front ends of the bifurcated portions 352*a*F as shown in FIG. 15B.

The contact portion (brake shoe portion) 352*d* in contact with the contact face 304*b*1 of the pinion gear 304*a* is formed by a resin member and may be fixed to the lever holder 352*b* formed by a metallic material. Therefore, there is a case in which the pinion gear 304*a* is excessively rotated when the pinion gear 304*a* continues to be driven by the engine at an instance of starting the engine after the pinion gear 304*a* of has been kicked impulsively and brought in mesh with the ring gear 300. However, even when the pinion gear 304*a* is rotated excessively, the lever 352 is brought into contact with the pinion gear 304*a* via the brake shoe portions 352*d* formed by a resin material. Accordingly, owing to heat conductivity of the resin material, heat conduction to the lever holder 352*b* containing the leaf spring 352*a* can be alleviated.

As shown in FIG. 15A, a packing 353 formed by a rubber member is provided on a surface of a rear face portion 351*a* fixed to the electromagnetic switch 306 and the starter motor 302 (center case 326). Thereby, a match face of the electromagnetic switch 306 and the starter motor 302 can be sealed by using the packing. Therefore, invasion of water or oil into an inner space of the starter including the shift lever device 305 can be prevented. Further, the packing 353 is provided with a projected wall 353*a* inserted into and fixed by a positioning hole 351*a*H of the rear face portion 351. Thereby, promotion of disassembling and assembling operational performance and a reduction in a cost of a spare part in the market are compatible.

Further, as shown in FIG. 15B, corner portions 352*b*T are provided on the side of the electromagnetic switch of the lever holder 352*b* of the lever 352. Therefore, the lever holder 352*b* can be projected to be longer than the leaf spring 352*a* in a direction orthogonal to the shaft of the pin 352*c*.

Thereby, the corner portions 352*b*T can be brought into contact with the plunger 361 such that the contact portion 352*a*T of the leaf spring 352*a* is not brought into contact with the movable portion 306*a* when the pinion gear 304*a* is stationary. Therefore, when the pinion gear 304*a* is brought in mesh with the ring gear 300 or after the pinion gear 304*a* has been in mesh therewith, impact load applied on the leaf spring can be restrained and can be received by the corner portion 352*b*T.

Further, it is preferable that the corner portion is provided with an end portion shape 352*b*TC capable of being brought into face contact with the plunger 361 constituting the driving device regardless of attitude, that is, inclination of the lever holder 352*b*. The end portion shape 352*b*TC may be a curved shape of R shape as shown in FIG. 15A to thereby carry out the face contact.

Further, other than the construction of the shift lever device 305 for applying set load to the leaf spring 352*a* explained in the embodiment, in which the shift lever device 305 is constructed with the apparatus of including the leaf spring 352*a* and the lever holder 352*b* for holding the leaf spring 352*a*, there may be constructed any construction of the shift lever device for only holding the leaf spring without applying the set load so far as the performance of bringing the pinion gear and the ring gear in mesh with each other is improved by utilizing spring force by the leaf spring.

The above modification of the second embodiment has the shift preventive structure of the leaf spring 352*a* and the structure of preventing breakage of the leaf spring 352*a* by excessive load in the lever 352 constituting the spring force generating apparatus S.

When the projected end portion 352*a*K does not catch the lever holder 352*b* by bending thereof but as shown in FIG. 15A, formed on a developed plane of the leaf spring 352*a*, there can be constructed a construction in which stress concentration is less likely to operate at the projected end portion 352*a*K even when the notched portion 352*b*K of the lever holder 352*b* is caught thereby.

Further, as shown in FIG. 15B, it is preferable that the projected portion 352*a*K is provided at a front end of at the bifurcated portion 352*a*F. Thereby, according to the lever 352 constituting the spring force generating apparatus S, load can be absorbed in accordance with a length to the projected portion 352*a*K constituting the end portion of the leaf spring 352*a*.

Next, as shown in FIG. 15A, the pin 352*c* constituting the support member is formed in a cylindrical shape. Accordingly, movement of an operating point for applying set load to the leaf spring 352*a* can be made smaller than in a polygonal shape such as a rectangular shape. Accordingly, excessive load accompanied by moving the leaf spring 352*a* can be made less likely to occur at the end portion 352*a*K.

Further, it is preferable to set to arrange the end portion 352*a*K as follows in relation to the pin 352*c* constituting the support member. That is, a distance of separating the pin 352*c* and the end portion 352*a*K is set to be larger than a movement amount for moving the leaf spring 352*a* owing to deformation thereof. Thereby, interference of the end portion 352*a*K with the pin 352*c* by deforming the leaf spring 352*a* can be avoided. Accordingly, excessive load can be prevented from being loaded on the leaf spring 352*a*.

According to the brake shoe portion 352*d*, as shown in FIG. 15B, it is preferable to provide a guide portion 352*d*G for guiding the end portion 352*a*K of the leaf spring 352*a*. Thereby, when the end portion 352*a*K is fixed by catching the lever holder 352*b*, performance of settling the end portion 352*a*K is promoted. Accordingly, positioning of the leaf spring 352*a* is facilitated.

The present invention should not be limited to the disclosed embodiments and modifications, but may be implemented in various ways without departing from the spirit of the invention.

What is claimed is:

1. A starter for engines, comprising:

an electromagnetic switch;

a pinion gear movable along an axial direction; and a shift lever for driving the pinion gear by the electromagnetic switch, the shift lever including a plurality of sheets of resilient leaf springs inclinedly supported at a middle portion thereof and having contact portions at both ends thereof, wherein the drive spring includes a slit end portion in which gaps are formed among the respective leaf springs at least at one of the contact portions and the respective leaf springs include the contact portions having differences of distal end positions longer than thickness of the respective leaf springs contiguous to each other and brought into contact with an opposing member at positions different from each other.

2. The starter as in claim 1, wherein the contact portions has curved faces.

* * * * *

UNITED STATES PATENT AND TRADEMARK OFFICE

CERTIFICATE OF CORRECTION

PATENT NO. : 6,959,619 B2
DATED : November 1, 2005
INVENTOR(S) : Mikio Saito

It is certified that error appears in the above-identified patent and that said Letters Patent is hereby corrected as shown below:

Title page,
Item [12], should read -- Saito --.
Item [75], Inventors, delete:
"Kazuhiro Ando, Okazaki (JP)
Kiyokazu Haruno, Kariya (JP)
Masahiro Katoh, Chiruy (JP)".

Signed and Sealed this

Twenty-fifth Day of April, 2006

JON W. DUDAS
*Director of the United States Patent and Trademark Office*